US008542256B2

(12) United States Patent
Kim

(10) Patent No.: US 8,542,256 B2
(45) Date of Patent: Sep. 24, 2013

(54) DIGITAL GAMMA CORRECTION SYSTEM AND METHOD

(75) Inventor: Eui Tae Kim, Seoul (KR)

(73) Assignee: LG Display Co., Ltd., Seoul (KR)

( * ) Notice: Subject to any disclaimer, the term of this patent is extended or adjusted under 35 U.S.C. 154(b) by 820 days.

(21) Appl. No.: 12/314,923

(22) Filed: Dec. 18, 2008

(65) Prior Publication Data

US 2009/0231256 A1 Sep. 17, 2009

(30) Foreign Application Priority Data

Mar. 17, 2008 (KR) ..... 10-2008-0024359

(51) Int. Cl.
*G09G 5/10* (2006.01)

(52) U.S. Cl.
USPC ..... 345/690; 348/671

(58) Field of Classification Search
USPC ..... 345/87–101, 690–693, 1.1–3.4, 204–207; 358/519; 348/671–675
See application file for complete search history.

(56) References Cited

U.S. PATENT DOCUMENTS 6,847,376 B2 * 1/2005 Engeldrum et al. ..... 345/600
2007/0057975 A1 * 3/2007 Oh et al. ..... 345/690

* cited by examiner

*Primary Examiner* — Liliana Cerullo
(74) *Attorney, Agent, or Firm* — McKenna Long & Aldridge LLP

(57) ABSTRACT

A digital gamma correction system for detecting a brightness of a liquid crystal panel, and correcting a gamma voltage, based on the detected brightness, includes an offset setter for setting the number of detection gray levels and a first detection area, for the detection of the brightness of the liquid crystal panel, a plurality of brightness detectors for detecting brightness values output from the first detection area for the detection gray levels, a controller for processing the brightness values detected by the brightness detectors, a non-linear interpolation data processor for processing a brightness value supplied from the controller, thereby generating non-linear interpolation data as a brightness variation rate according to the gray levels, a brightness corrector for generating gamma correction data for brightness values obtained by interpolating brightness values detected in a second detection area of another liquid crystal panel for a second number of detection gray levels, based on the non-linear interpolation data, and a memory for storing the gamma correction data generated from the brightness corrector.

7 Claims, 11 Drawing Sheets

DIGITAL GAMMA CORRECTION SYSTEM AND METHOD

This application claims the benefit of the Korean Patent Application No. P2008-024359, filed on Mar. 17, 2008, which is hereby incorporated by reference as if fully set forth herein.

BACKGROUND OF THE INVENTION

1. Field of the Invention

The present invention relates to a liquid crystal display device, and more particularly, to a digital gamma correction system and method capable of reducing a tact time, using a non-linear interpolation scheme.

2. Discussion of the Related Art

Recently, various flat panel display devices capable of reducing the drawbacks of a cathode ray tube, namely, weight and volume, have been developed. Such flat panel display devices include a liquid crystal display (LCD) device, a field emission display device, a plasma display panel, a light emitting display device, etc.

Of such flat panel display devices, the LCD device displays an image by controlling the light transmittance of liquid crystals in accordance with a video signal. In the LCD device, gamma characteristics are exhibited. That is, in accordance with the voltage level of the video signal, the gray level of the image is not varied in a linear manner, but varied in a non-linear manner. This is because the light transmittance of liquid crystals is varied in a non-linear manner in accordance with the voltage level of the video signal, and the gray level of the image is varied in a non-linear manner in accordance with the light transmittance of the liquid crystals.

In order to prevent the image from being degraded due to such gamma characteristics, the LCD device varies the intervals of voltage levels of video signals, using gamma correction voltages. In other words, in the LCD device, gamma correction voltages, which have different voltage levels in accordance with the voltage levels of the associated video signals, are added, as offset voltages, to the voltage levels of the video signals, respectively, to achieve a correction of gamma characteristics.

In order to achieve a correction of gamma characteristics, accordingly, LCD devices of the related art use, in the manufacturing stage thereof, a gamma corrector to conduct a measurement of brightness, and to correct gamma characteristics in accordance with the results of the measurement. In other words, as shown in FIG. 1, the brightness of a liquid crystal panel displaying an image in accordance with an external input signal is measured. Based on brightness values respectively corresponding to different gray scales, a contrast ratio and gray curve is created. Using the contrast ratio and gray curve, gamma reference voltages are set.

For the gamma correction to set gamma reference voltages, a multi-break point correction and a "look-up table"-based correction, which use an analog circuit or a digital circuit, are generally known. Although the "look-up table"-based correction method, which uses a digital circuit, was known as having a problem of a increased circuit size as compared to other methods, this problem has been reduced in accordance with the recent IC integration improvement. Since the "look-up table"-based correction method has an advantage of a high correction accuracy, the "look-up table"-based correction method using a digital circuit has mainly been used.

FIG. 2A shows the correction results obtained when the brightness of a liquid crystal panel is measured for 256 gray levels of a 8-bit bit code, and is then linearly interpolated for 10 bits. FIG. 2B shows the correction results obtained when the brightness of a liquid crystal panel is measured for 46 gray levels of a 8-bit bit code, and is then linearly interpolated for 10 bits. FIG. 2C is the correction results obtained when the brightness of a liquid crystal panel is measured for 25 gray levels of a 8-bit bit code, and is then linearly interpolated for 10 bits.

As shown in FIGS. 2A to 2C, when the number of detection gray levels to measure a brightness variation occurring between adjacent ones of gray levels increasing sequentially in a full white mode is reduced, the number of interpolation sections increases. When the gray levels increase sequentially, and the number of measurement points are large, as shown in FIG. 2A, the interpolation based on measured data has a gently-increasing gradient. However, when the number of measurement points is reduced, as shown in FIG. 2C, the number of interpolation sections increases because the number of measurement data is reduced. As a result, a step is generated at each measurement point.

Although it is possible to supply gamma correction data suitable for a liquid crystal panel by increasing the number of detection gray levels, an increase in tact time occurs in this case. On the other hand, when a linear interpolation is carried out under the condition in which the number of detection gray levels is reduced to reduce the tact time, there may be a problem in that it is impossible to estimate a brightness to be corrected at each gray level, due to irregular output voltage characteristics of a data driver.

Furthermore, there may be a problem in that a degradation in brightness occurs because it is impossible to supply suitable gamma correction data in accordance with the characteristics of the liquid crystal panel, for which gamma voltage are to be corrected.

SUMMARY OF THE INVENTION

Accordingly, the present invention is directed to a digital gamma correction system and method that substantially obviates one or more problems due to limitations and disadvantages of the related art.

An advantage of the present invention is to provide a digital gamma correction system and method, which is capable of estimating and recovering original data values while minimizing the number of detection gray levels to achieve a reduction in tact time.

Additional advantages and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these and other advantages and in accordance with the purpose of the invention, as embodied and broadly described herein, a digital gamma correction system for detecting a brightness of a liquid crystal panel, and correcting a gamma voltage, based on the detected brightness, comprises: an offset setter for setting the number of detection gray levels and a first detection area, for the detection of the brightness of the liquid crystal panel; a plurality of brightness detectors for detecting brightness values output from the first detection area for the detection gray levels; a controller for processing the brightness values detected by the brightness detectors; a non-linear interpolation data processor for processing a brightness value supplied from the controller, thereby generating non-linear interpolation data as a brightness variation rate according to the gray levels; a brightness corrector for generating gamma correction data for brightness values obtained by interpolating brightness values detected in a second detection area of another liquid crystal panel for a second number of detection gray levels, based on the non-linear interpolation data; and a memory for storing the gamma correction data generated from the brightness corrector.

In another aspect of the present invention, a digital gamma correction method comprises: A) measuring a brightness value output from a first detection area in a first liquid crystal panel while varying a gray level, thereby generating a normalizing curve as a reference; B) executing a non-linear interpolation for brightness values measured in another liquid crystal panel in accordance with variation rates of the measured brightness values, while referring to the normalizing curve, thereby generating gamma reference voltages; and C) matching each gamma reference voltage of the another liquid crystal panel with an ideal gamma reference voltage, thereby generating gamma correction data.

The step A may comprise: setting, in an offset setter, the number of first detection gray levels, at which a brightness of the first liquid crystal panel will be detected in a first detection region as a detection region of the first liquid crystal panel; detecting brightness values by a plurality of brightness detectors for the number of the first detection gray levels; interpolating the detected brightness values by a controller, to generate brightness values corresponding to gray levels suitable for the first liquid crystal panel; calculating variation rates of the interpolated brightness values according to the variation of the gray levels; normalizing the brightness variation rates according to the gray levels variation, thereby creating normalizing curves; and calculating an average of the normalizing curves created in accordance with the brightness values detected by the brightness detectors, and storing the normalizing curve average in a non-linear interpolation data storing unit.

The step B may comprise: setting, in the offset setter, the number of second detection gray levels, at which a brightness of the another liquid crystal panel will be detected in a second detection region as a detection region of the another liquid crystal panel; executing a non-linear interpolation for the brightness values detected from the another liquid crystal panel, while referring to the brightness variation rate stored in the non-linear interpolation data storing unit for each gray level; and generating gamma reference voltages, based on the non-linearly interpolated brightness values.

The number of the second detection gray levels may be smaller than the number of the first detection gray levels, to achieve a reduction in tact time.

In accordance with the digital gamma correction system and method of the present invention, brightness variation rates detected in the first detection area of the first liquid crystal panel is referred to when it is desired to detect the brightness of another liquid crystal panel in the second detection area, in order to detect the brightness of the another liquid crystal panel in accordance with the brightness variation rates such that the brightness detection is executed for a reduced number of detection gray levels in a range where a small brightness variation is exhibited, and for an increased number of detection gray levels in a range where a large brightness variation is exhibited.

Even in the case in which a reduced number of detection gray levels is used, it is possible to provide a soft brightness to the liquid crystal panel, using the non-linear interpolation data.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and along with the description serve to explain the principle of the invention. In the drawings.

DETAILED DESCRIPTION OF THE INVENTION

Reference will now be made in detail to the preferred embodiments of the present invention, examples of which are illustrated in the accompanying drawings.

Figure 3:
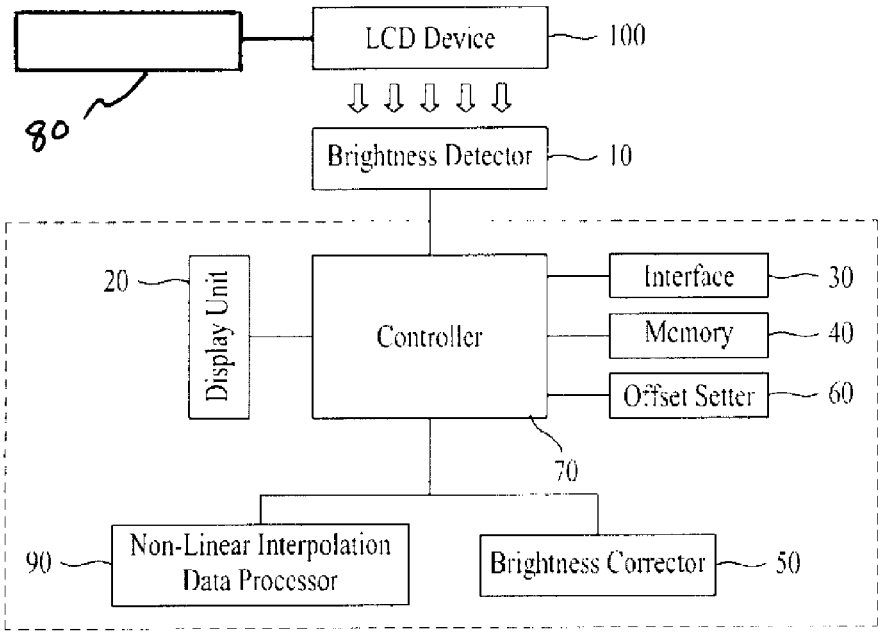
FIG. 3 is a block diagram illustrating a digital gamma correction system according to an exemplary embodiment of the present invention.

FIG. 3 illustrates a digital gamma correction system according to an exemplary embodiment of the present invention.

Referring to FIG. 3, the digital gamma correction system according to the illustrated embodiment of the present invention, which detects the brightness of a liquid crystal panel 100, to correct a gamma voltage, includes an offset setter 60 for setting the number of detection gray level bits and a first detection area, for the detection of the brightness of the liquid crystal panel 100, a plurality of brightness detectors 10 for detecting brightness values output from the first detection area for different gray levels, a controller 70 for processing the brightness values detected by the brightness detectors 10, and a non-linear interpolation data processor 90 for processing a brightness value supplied from the controller 70, for each gray level, thereby generating non-linear interpolation data as a brightness variation rate for the gray level. The digital gamma correction system also includes a brightness corrector 50 for generating gamma correction data for brightness values obtained by interpolating brightness values detected in a second detection area of another liquid crystal panel for a second number of detection gray levels, based on the non-linear interpolation data, and a memory 40 for storing the gamma correction data generated from the brightness corrector 50.

The offset setter 60 provides predetermined offset values to the controller 70. The offset setter 60 may set offset values, which will be used in an initialization mode, in which non-linear interpolation data is generated as an initial value for the measurement of brightness, and a measurement mode, in which the brightness of the liquid crystal panel 100 is measured. In the initialization mode, the offset setter 60 sets the number of detection gray levels, at which the brightness of the liquid crystal panel 100 will be detected by the plurality of brightness detectors 10 arranged in the first detection area of the liquid crystal panel 100. In the measurement mode, the offset setter 60 executes a setting operation such that brightness values detected in another liquid crystal panel for a reduced number of detection gray levels can be interpolated based on non-linear interpolation data generated in the initialization mode.

The signal input unit 80 supplies video signals to the liquid crystal panel 100. In order to enable the brightness detectors 10 to measure a brightness variation according to a variation in gray level, the signal input unit 80 sequentially supplies, to the liquid crystal panel 100, video signals corresponding to respective gray levels.

The liquid crystal panel 100 outputs a brightness value in accordance with the gray level of a video signal supplied from the signal input unit 80. The liquid crystal panel 100 includes a transistor array substrate and a color filter array substrate, which are assembled such that they face each other. The liquid crystal panel 100 also includes spacers (not shown) for maintaining a desired cell gap between the two array substrates, and a liquid crystal layer (not shown) filled in a liquid crystal space maintained by the spacers.

The color filter array substrate, which is an upper substrate, includes at least three color filters of red, green, and blue for each pixel cell of the liquid crystal panel 100. The color filter array substrate also includes a black matrix defining the pixel cells while separating the color filters from one another, and a common electrode to which a common voltage is supplied. The common electrode may be formed at the transistor array substrate, which is a lower substrate, in accordance with the mode of liquid crystals.

The lower substrate includes a plurality of data lines and a plurality of gate lines, which are formed such that they intersect each other, to define pixel regions. In each pixel region, the lower substrate also includes a thin film transistor (TFT), and a pixel electrode connected to the TFT. The TFT supplies, to a corresponding liquid crystal cell Clc, a video signal from a corresponding one of the data lines in response to a gate pulse from a corresponding one of the gate lines.

The liquid crystal cell Clc is constituted by the common electrode and the pixel electrode of the TFT facing the common electrode via the liquid crystal layer. In this regard, the liquid crystal cell Clc may be equivalently represented as a liquid crystal capacitor. The liquid crystal cell Clc also includes a storage capacitor Cst for maintaining a video signal charged in the liquid crystal capacitor until a next video signal is charged in the liquid crystal capacitor.

The plurality of brightness detectors 10 detect brightness values output from the front surface of the liquid crystal panel 100. That is, the brightness detectors 10 detect a variation in the brightness outputted from the first detection area of the liquid crystal panel 100 in accordance with each gray level set by the offset setter 60 and the video signal supplied from the signal input unit 80. The brightness detectors 10 supply the detected values to the controller 70. In the initialization mode, the brightness detectors 10 measure brightness for all gray levels in accordance with the offset value set by the offset setter 60. In the measurement mode, however, the brightness detectors 10 detect the brightness of the liquid crystal panel 100, taking into consideration the brightness variation according to the gray levels. That is, the brightness detection is executed for a reduced number of detection gray levels in a range where a small brightness variation is exhibited, and for an increased number of detection gray levels in a range where a large brightness variation is exhibited. Each brightness detector 10 may be a camera capable of acquiring a brightness value output from the liquid crystal panel 100.

The controller 70 processes brightness values detected by the plurality of brightness detectors 10 for the brightness of the liquid crystal panel 100. In this case, the controller 70 outputs a control signal for controlling the digital gamma correction system, receives the brightness values detected by the brightness detectors 10, and processes the received brightness values. In the initialization mode set by the offset setter 60, the controller 70 supplies the brightness values of the liquid crystal panel 100 initially detected by the brightness detectors 10 to the non-linear interpolation data processor 90, in order to enable the non-linear interpolation data processor 90 to generate non-linear interpolation data as reference data. Subsequently, in the measurement mode, the controller 70 stores, in the memory 40, gamma correction data obtained by correcting the brightness of another liquid crystal panel, which has been measured, in the brightness corrector 50 based on the non-linear interpolation data from the non-linear interpolation data processor 90.

Figure 4:
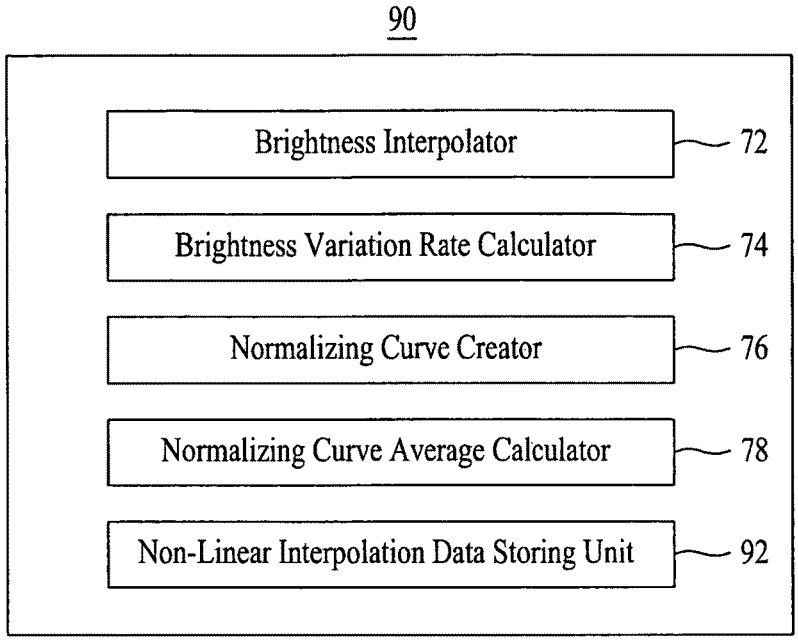
FIG. 4 is a block diagram illustrating a non-linear interpolation data processor according to an exemplary embodiment of the present invention.

The non-linear interpolation data processor 90 processes brightness values supplied to the controller 70 in the initialization mode set by the offset setter 60, thereby generating a brightness variation rate according to the gray levels. As shown in FIG. 4, the non-linear interpolation data processor 90 includes a brightness interpolator 72 for interpolating measured brightness values, a brightness variation rate calculator for calculating variation rates of the interpolated brightness values, a normalization curve creator 76 for creating normalizing curves, using the calculated interpolated brightness variation rates, a normalizing curve average calculator 78 for calculating an average of the normalizing curves, and a non-linear interpolation data storing unit 92 for storing the normalizing curve average.

The brightness interpolator 72 interpolates the brightness values supplied from the controller 70, to generate brightness values corresponding to gray levels suitable for the liquid crystal panel 100. That is, the brightness interpolator 72 receives brightness values detected for respective gray levels measured in the measurement mode set by the offset value of the offset setter 60, and interpolates the brightness values, to create brightness values corresponding to gray levels suitable for the liquid crystal panel 100.

The brightness variation rate calculator 74 receives the interpolated brightness values from the brightness interpolator 72, and calculates a brightness variation rate according to the gray levels.

Figure 5A:
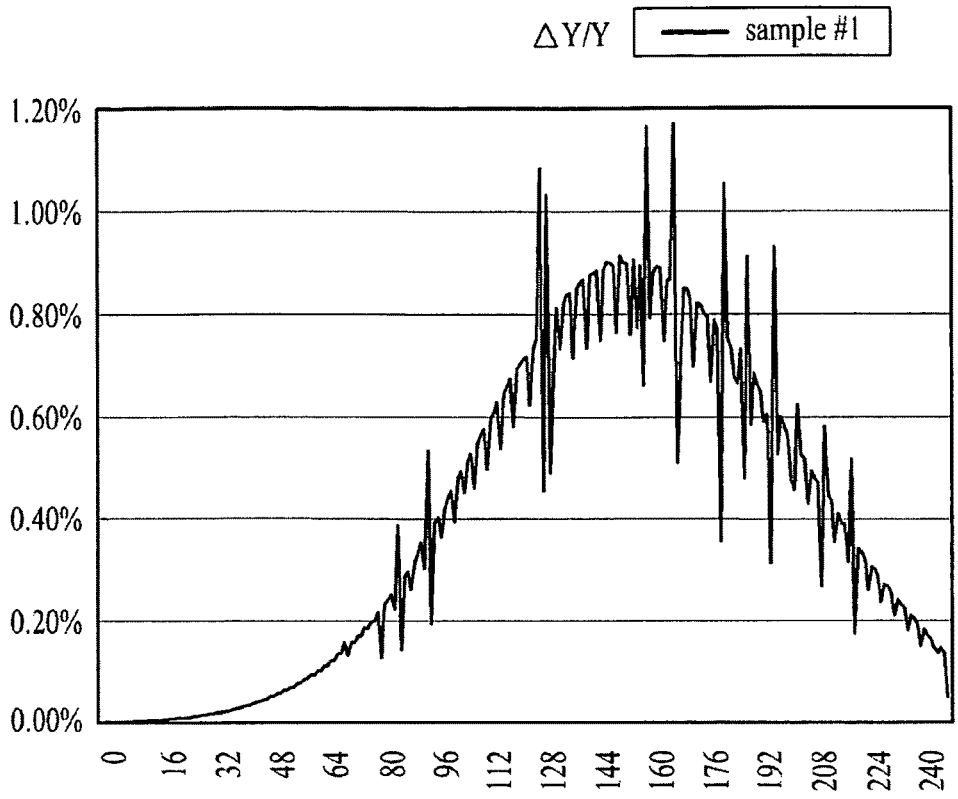
FIGS. 5A to 8 are graphs for explaining a correction procedure according to a digital gamma correction method according to an exemplary embodiment of the present invention.
Figure 5B:
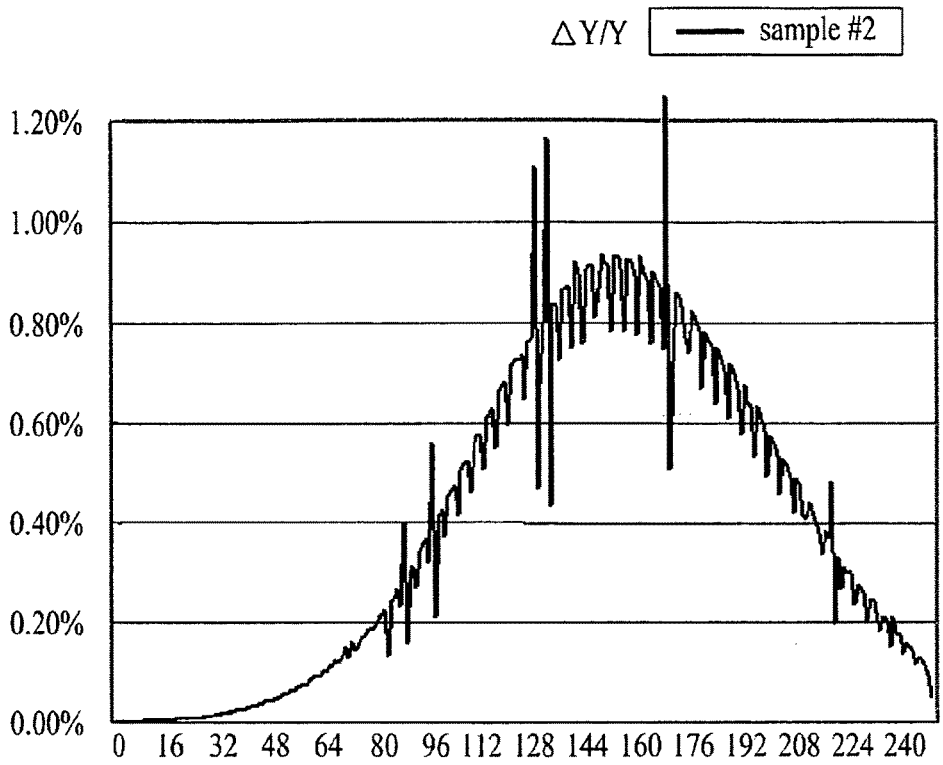
Figure 5C:
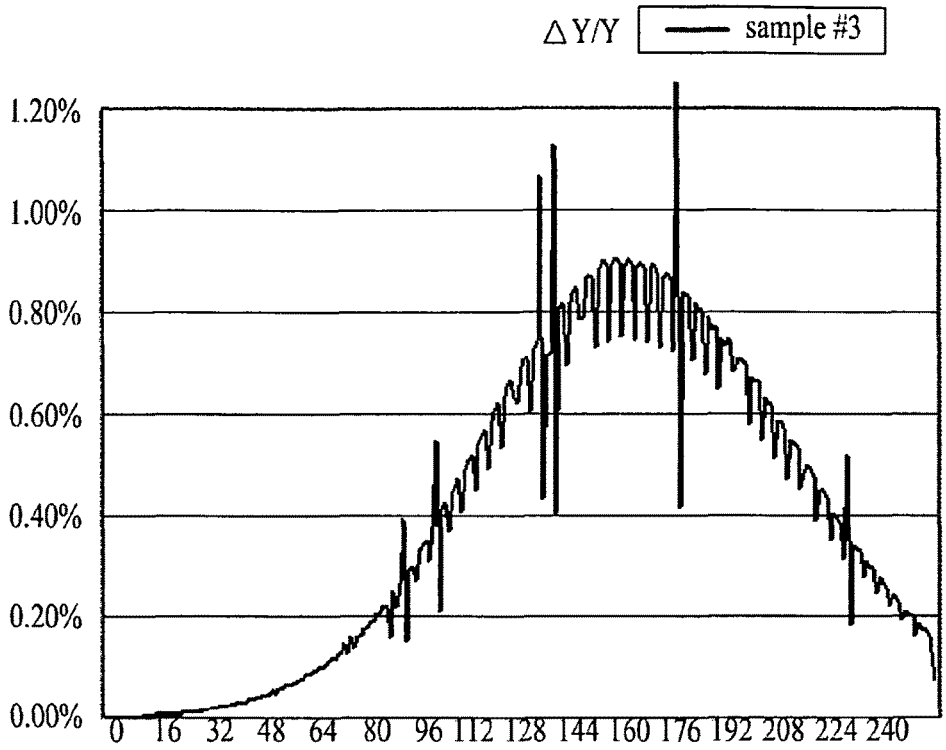

The normalizing curve creator 76 creates normalizing curves, using the brightness variation rates according to the gray levels supplied from the brightness variation rate calculator 74. In this case, as shown in FIGS. 5A to 5C, the normalizing curve creator 76 creates normalizing ($\Delta Y/Y$) curves according to the gray levels, using the brightness variation rates according to the gray levels calculated by the brightness variation rate calculator 74.

The normalizing curve average calculator 78 calculates an average of the normalizing curves created by the normalizing curve creator 76, using the brightness values according to the gray levels measured by the plurality of the brightness detectors 10. The normalizing curve average calculator 78 then supplies the normalizing curve average to the non-linear interpolation data storing unit 92.

The non-linear interpolation data storing unit 92 stores the normalizing curve average output from the normalizing curve average calculator 78. In this case, the non-linear interpolation data storing unit 92 stores the average of the normalizing curves, which normalize brightness variation rates calculated in accordance with a processing operation for the brightness values detected by the brightness detectors 10. The stored normalizing curve average will be used as reference data, upon the brightness measurement for another liquid crystal panel.

The brightness corrector 50 generates gamma correction data for another liquid crystal panel, while referring to the data stored in the non-linear interpolation data storing unit 92, in the measurement mode set by the offset setter 60. The brightness corrector 50 detects brightness values of another liquid crystal panel measured by the plurality of brightness detectors 10 after the execution of the initialization mode, and corrects the detected brightness values. That is, the brightness corrector 50 detects brightness values of another liquid crystal panel selectively measured in accordance with the brightness variation rates stored as the non-linear interpolation data. Thereafter, the brightness corrector 50 interpolates the detected brightness values while referring to the non-linear interpolation data stored in the non-linear interpolation data storing unit 92. Subsequently, the brightness corrector 50 generates gamma correction data to be corrected to an ideal gamma curve, using the interpolated brightness values, and stores the gamma correction data in the memory 40.

The memory 40 stores the gamma correction data generated by the brightness corrector 50. That is, the memory 40 stores the gamma correction data generated by the brightness corrector 50 using the non-linear correction data, in the form of a look-up table.

The digital gamma correction system also includes a display unit 20 for displaying values measured by the above-described units of the system. The display unit 20 displays the brightness value measured by each brightness detector 10, the interpolation data processed by the non-linear interpolation data processor 90, and data corrected by the brightness corrector 50. The display unit 20 may include an e-paper, a liquid crystal display (LCD) panel, a field emission display panel, a plasma display panel, a light emitting display panel, etc.

The digital gamma correction system further includes an interface 30 for transmitting the gamma correction data stored in the memory 40 in the form of a look-up table, in order to enable the gamma correction data to be used for another liquid crystal panel.

Thus, the digital gamma correction system having the above-described configuration refers to the brightness variation rates detected in the first detection area of a first liquid crystal panel by the plurality of brightness detectors upon the brightness measurement for a gamma correction, and stored in the non-linear interpolation data processor, when it is desired to detect the brightness of another liquid crystal panel in the second detection area, in order to detect the brightness of the another liquid crystal panel in accordance with the brightness variation rates such that the brightness detection is executed for a reduced number of detection gray levels in a range where a small brightness variation is exhibited, and for an increased number of detection gray levels in a range where a large brightness variation is exhibited. Accordingly, it is possible to reduce the tact time required for the gamma correction of liquid crystal panels in the mass production of LCD devices.

FIGS. 5A to 8 are views illustrating a correction procedure according to a correction method carried out by the digital gamma correction system in accordance with an exemplary embodiment of the present invention.

Referring to FIGS. 5A to 8, the correction method carried out by the digital gamma correction system in accordance with the illustrated embodiment of the present invention includes step A of measuring a brightness value output from the first detection area in a first liquid crystal panel while varying gray levels in accordance with the number of gray level bits, thereby generating a normalizing curve as a reference, step B of executing a non-linear interpolation for brightness values output from the second detection area in another liquid crystal panel in accordance with variation rates of the brightness values output from the second detection area, while referring to the normalizing curve, thereby generating gamma reference voltages, and step C of matching each gamma reference voltage of the another liquid crystal panel with an ideal gamma reference voltage, thereby generating gamma correction data.

At step A, the first detection area, at which brightness is detected from a first liquid crystal panel, and the number of first detection gray levels are set in the offset setter.

Thereafter, in order to detect the brightness of the liquid crystal panel, the gray level of an input video signal is sequentially varied in accordance with the number of the first detection gray levels set in the offset setter. Brightness values of the liquid crystal panel sequentially output from the first detection area as the gray level of the input video signal is sequentially varied are then detected by the plurality of brightness detectors.

The controller, which receives the brightness values detected from the first liquid crystal panel, processes the received brightness values, and then supplies the processed brightness values to the non-linear interpolation data processor, in order to enable the non-linear interpolation data processor to generate non-linear interpolation data as an initial value.

Figure 1:
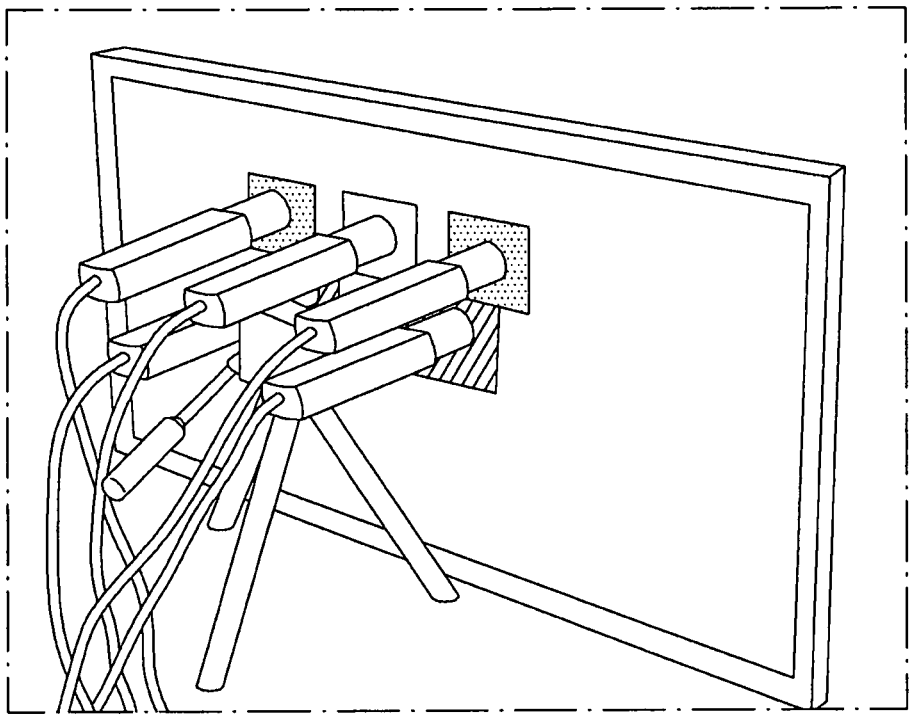
FIG. 1 Related Art
FIG. 1 is a perspective view illustrating brightness detectors of the related art used to detect the brightness of a liquid crystal panel.
Figure 2A:
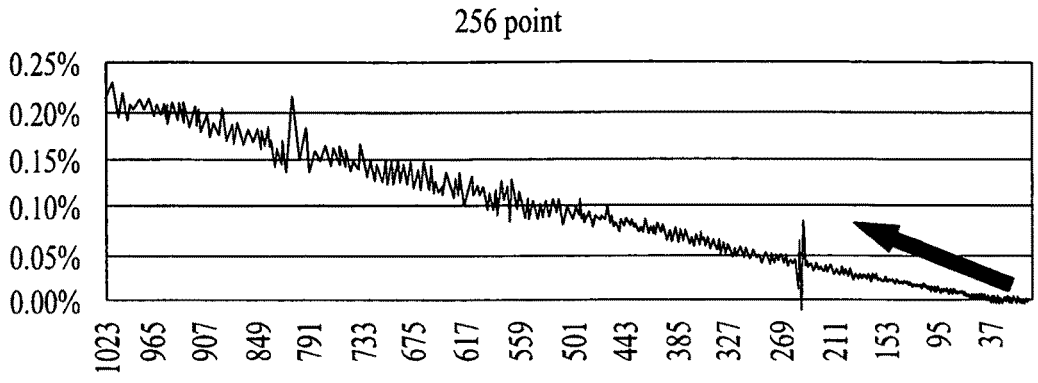
FIG. 2A (RELATED ART)
FIGS. 2A to 2C are graphs showing a brightness variation rate between adjacent ones of gray levels linearly interpolated in accordance with the number of detection gray levels of the related art.
Figure 2B:
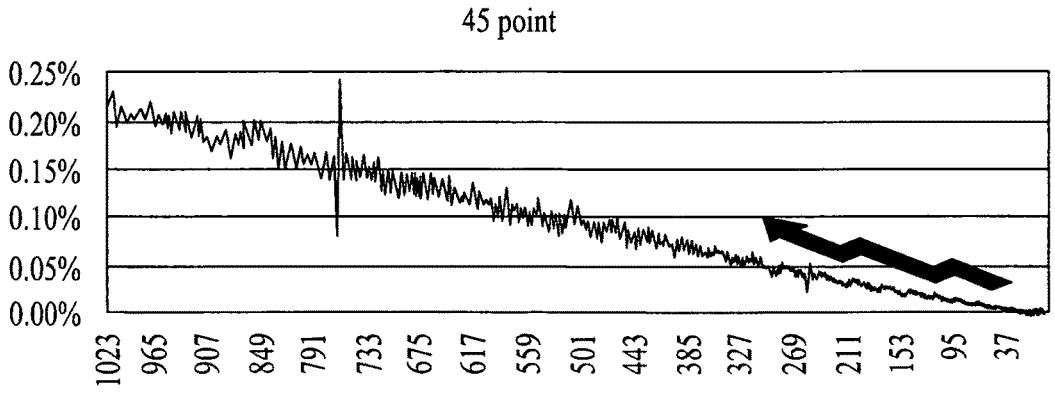
FIG. 2B (RELATED ART)
Figure 2C:
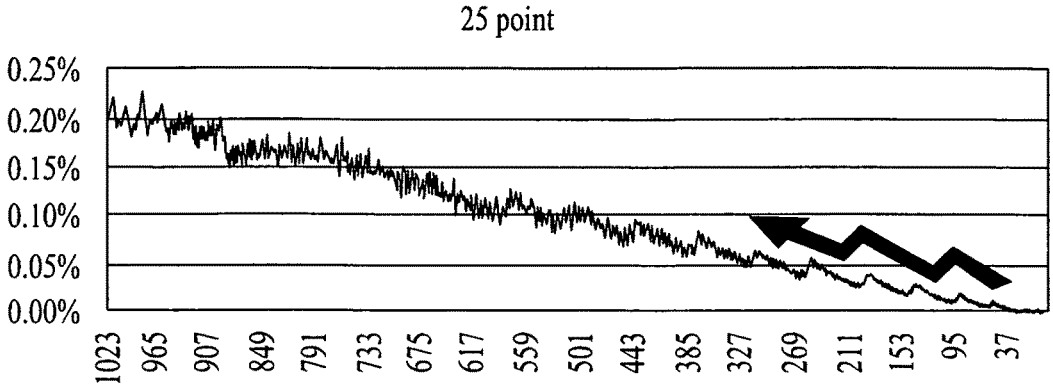
FIG. 2C (RELATED ART)

Thereafter, the non-linear interpolation data processor interpolates the brightness values detected from the first detection area of the liquid crystal panel by the brightness detectors, to generate brightness values corresponding to gray levels suitable for the liquid crystal panel, as shown in FIGS. 2A to 2C.

Subsequently, the brightness variation rate calculator 74 calculates a brightness variation rate at each gray level, based on the brightness values interpolated in the brightness interpolator in accordance with the brightness values supplied from the brightness detector.

As shown in FIGS. 5A to 5C, the normalizing curve creator creates normalizing curves, using the brightness variation rates calculated by the brightness variation rate calculator in accordance with the brightness values supplied from the brightness detector.

Figure 6:
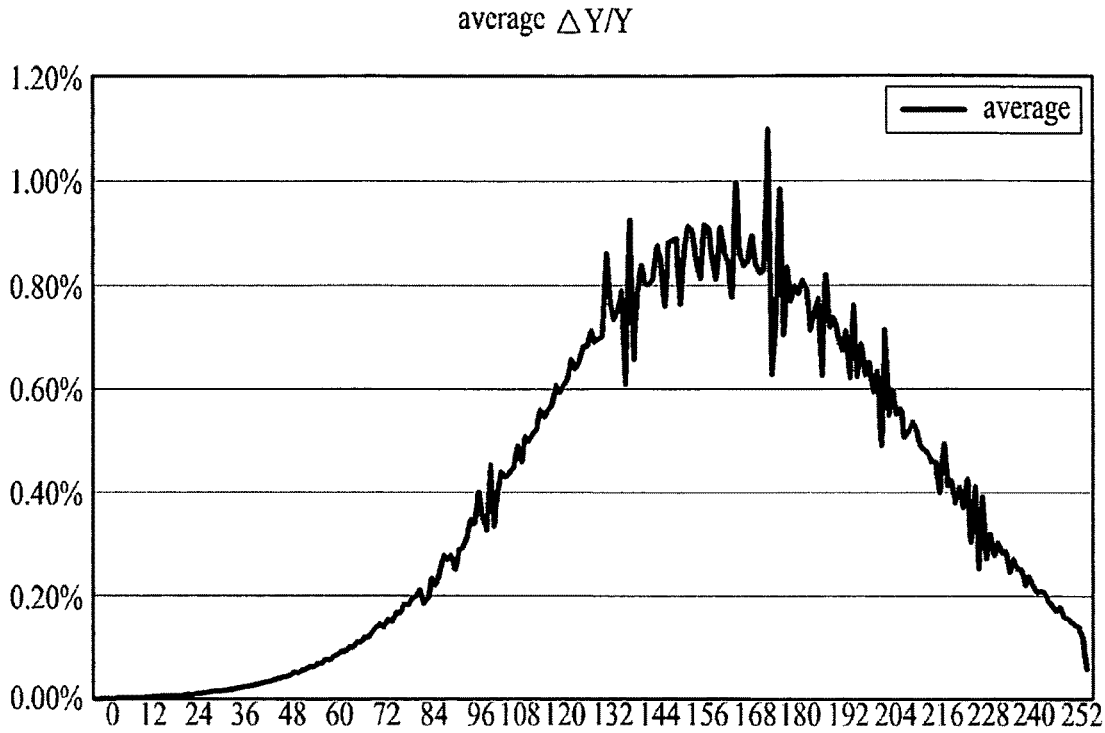
Figure 7:
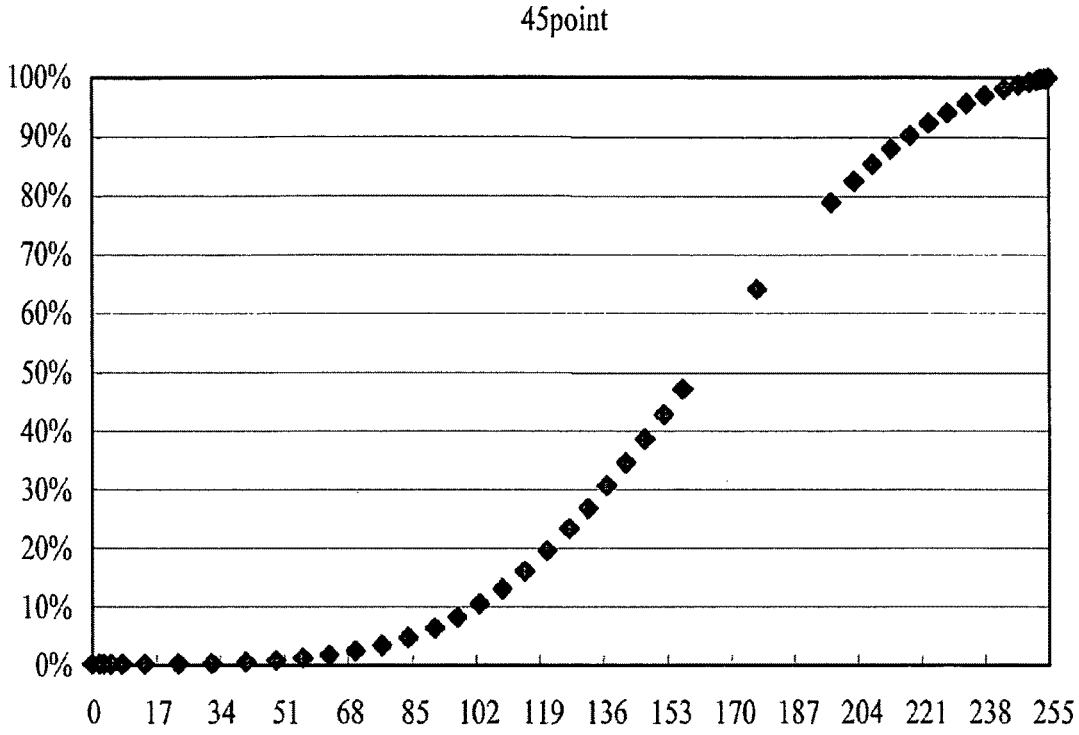

Thereafter, the normalizing curve average calculator calculates an average of the normalizing curves created by the normalizing curve creator, based on the brightness variation rates according to the gray levels, as shown in FIG. 6.

The normalizing curve average output from the normalizing curve average calculator, namely, non-linear interpolation data, is then stored in the non-linear interpolation data storing unit.

At step B, the second detection area, at which brightness is detected from another liquid crystal panel, and the number of second detection gray levels are set in the offset setter, different from step A at which the brightness values of the first liquid crystal panel for all gray levels are measured.

Thereafter, in order to detect the brightness of the liquid crystal panel at the second detection area, the gray level of an input video signal is sequentially varied in accordance with the number of the second detection gray levels (45 gray levels) set in the offset setter. Brightness values of the liquid crystal panel sequentially output from the second detection area as the gray level of the input video signal is sequentially varied are then detected by the plurality of brightness detectors. In this case, taking into consideration the brightness variation according to the gray levels, the number of detection gray levels is increased in a range where a large brightness variation is exhibited, while being reduced in a range where a small brightness variation is exhibited.

Thereafter, the brightness values detected from the second detection area at the second gray levels are interpolated to generate brightness values at gray levels at which any brightness variation cannot be detected due to a small variation rate.

Figure 8:
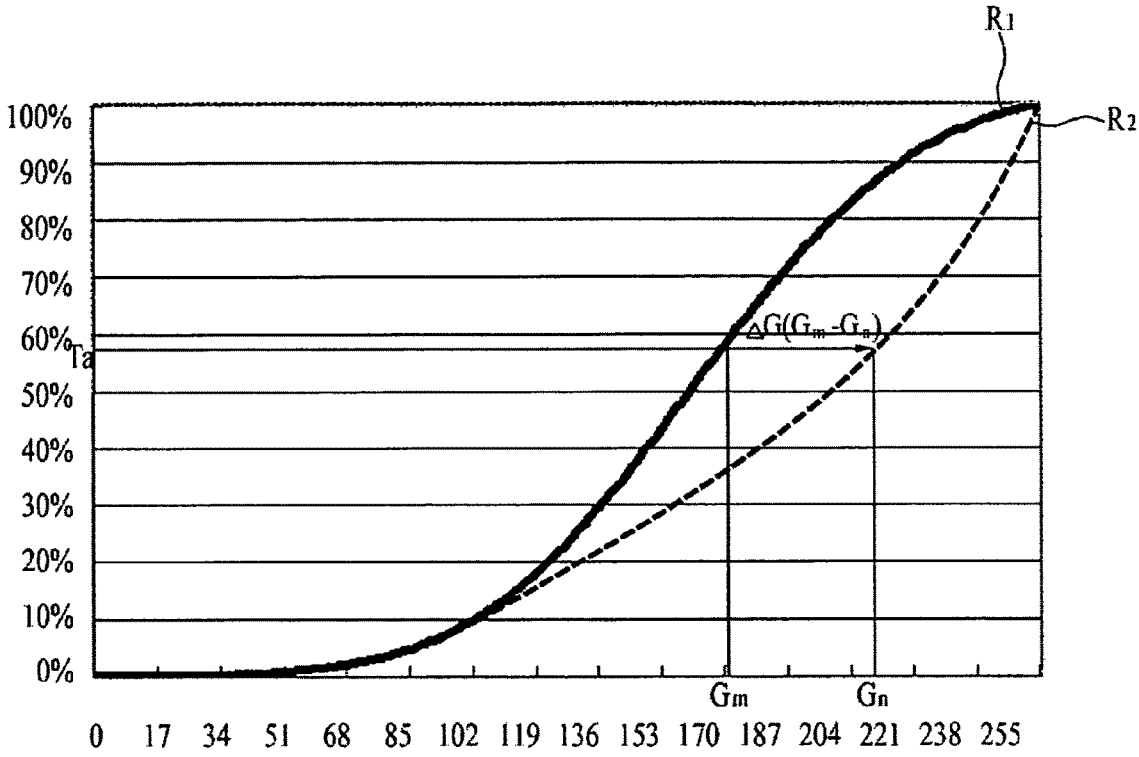

At step C, as shown in FIG. 8, gamma correction data is generated in accordance with the brightness values of the another liquid crystal panel interpolated based on the non-linear interpolation data, to correct a gamma voltage $R_1$ such that the it corresponds to an ideal gamma voltage $R_2$. For example, although the brightness value of the liquid crystal panel at a point where the transmittance of the liquid crystal panel is Ta corresponds to a non-linearly interpolated gray level $G_m$, the gamma voltage corresponding to the gray level $G_m$ is corrected ($\Delta G(G_n-G_m)$, so that a gamma voltage corresponding to a gray level $G_n$ is output.

Thus, the gamma correction method carried out in the digital gamma correction system in accordance with the present invention executes the brightness measurement for the first liquid crystal panel at 256 gray levels, taking into consideration problems associated with the tact time, etc., interpolates the measured brightness values, to generate brightness values corresponding to 4,096 gray levels (12 bits) or 1,024 gray levels (10 bits) suitable for the liquid crystal panel, and generates non-linear interpolation data representing brightness variation rates according to the gray levels gray level. Upon subsequently executing the brightness measurement for another liquid crystal panel, the gamma correction method executes the brightness measurement, taking into consideration a brightness variation, in place of the brightness values measured in the first liquid crystal panel for the 256 gray levels (8 bits), such that the brightness measurement is executed for an increased number of detection gray levels in a range where a large brightness variation is exhibited, and for a reduced number of detection gray levels in a range where a small brightness variation is exhibited. Thus, it is possible to reduce the tact time, using the non-linear interpolation scheme.

Even in the case in which a reduced number of detection gray levels is used, it is possible to provide a soft brightness to the liquid crystal panel, using the non-linear interpolation data.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A digital gamma correction system for detecting a brightness of a first liquid crystal panel, and correcting a gamma voltage, based on a detected brightness, comprising:

a first detection area of the first liquid crystal panel;

a plurality of brightness detectors for detecting first brightness values output from the first detection area according to a first number of detection gray levels;

a controller for processing the first brightness values detected by the brightness detectors;

an offset setter to provide offset values to the controller to set the first number of detection gray levels at which the brightness of the first liquid crystal panel is detected in an initialization mode and, in a measurement mode, to execute a setting operation for a reduced number of detection gray levels at which second brightness values that are detected in a second liquid crystal panel that are interpolated based on non-linear interpolation data generated in the initialization mode;

a non-linear interpolation data processor for processing the first brightness values supplied from the controller, thereby generating the non-linear interpolation data as a brightness variation rate corresponding to a greater number of gray levels than the first number of detection gray levels;

a brightness corrector for generating gamma correction data for brightness values obtained by interpolating the second brightness values detected in a second detection area of a second liquid crystal panel for a second number of detection gray levels, based on the non-linear interpolation data; and a memory for storing the gamma correction data generated from the brightness corrector, wherein when the brightness detectors detect the second brightness values of the second liquid crystal panel in the measurement mode, a brightness detection is executed for the reduced number of detection gray levels in a range where a small brightness variation is exhibited, and for an increased number of detection gray levels in a range where a large brightness variation is exhibited.

2. The digital gamma correction system according to claim 1, wherein an amount of the second number of detection gray levels is smaller than the first number of detection gray levels.

3. The digital gamma correction system according to claim 1, wherein the non-linear interpolation data processor comprises:

a brightness interpolator for interpolating the first brightness values;

a brightness variation rate calculator for calculating brightness variation rates of interpolated brightness values;

a normalization curve creator for creating normalizing curves, using calculated brightness variation rates;

a normalizing curve average calculator for calculating an average of the normalizing curves; and a non-linear interpolation data storing unit for storing the average of the normalizing curves.

4. A digital gamma correction method comprising:

A) setting an offset setter to measure first brightness values output from a first detection area in a first liquid crystal panel while varying gray levels in an initialization mode, thereby generating a normalizing curve as a reference;

B) executing in the offset setter a non-linear interpolation for second brightness values measured in a second liquid crystal panel in accordance with variation rates of the second brightness values in a measurement mode, while referring to the normalizing curve, thereby generating gamma reference voltages; and C) matching each gamma reference voltage of the second liquid crystal panel with an ideal gamma reference voltage, thereby generating gamma correction data, wherein when measuring the second brightness values of the second liquid crystal panel in the measurement mode, a brightness measurement is executed for a reduced number of detection gray levels in a range where a small brightness variation is exhibited, and for an increased number of detection gray levels in a range where a large brightness variation is exhibited.

5. The digital gamma correction method according to claim 4, wherein the step A comprises:

setting, in the offset setter, a number of first detection gray levels at which the first brightness values of the first liquid crystal panel are detected;

detecting the first brightness values with a plurality of brightness detectors at each of the first detection gray levels;

interpolating the first brightness values by a controller, to generate interpolated brightness values corresponding to gray levels suitable for the first liquid crystal panel;

calculating variation rates of interpolated first brightness values according to the variation of the first detection gray levels;

normalizing the variation rates according to gray level variations, thereby creating normalizing curves; and calculating an average of the normalizing curves in accordance with the first brightness values, and storing the average in a non-linear interpolation data storing unit.

6. The digital gamma correction method according to claim 5, wherein the step B comprises:

setting, in the offset setter, a number of second detection gray levels at which the second brightness values of the second liquid crystal panel are detected in a second detection area of the second liquid crystal panel;

executing a non-linear interpolation for the second brightness values while referring to the variation rates; and generating gamma reference voltages, based on the non-linear interpolation for the second brightness values.

7. The digital gamma correction method according to claim 6, wherein the amount of the second number of detection gray levels is smaller than the first number of detection gray levels.

* * * * *